US010680366B1

(12) United States Patent
Huang et al.

(10) Patent No.: US 10,680,366 B1
(45) Date of Patent: Jun. 9, 2020

(54) CONNECTOR ASSEMBLY AND JUMPER CONNECTOR THEREOF

(71) Applicant: Tarng Yu Enterprise co., ltd., New Taipei (TW)

(72) Inventors: Mu-Jung Huang, New Taipei (TW); Ying-Chung Chen, New Taipei (TW)

(73) Assignee: TARNG YU ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 16/533,785

(22) Filed: Aug. 7, 2019

(30) Foreign Application Priority Data

Dec. 26, 2018 (TW) ..... 107147139

(51) Int. Cl.

| | |
|---|---|
| ***H01R 31/08*** | (2006.01) |
| ***H01R 12/73*** | (2011.01) |
| ***H01R 12/72*** | (2011.01) |
| ***H01R 13/424*** | (2006.01) |
| ***H01R 13/502*** | (2006.01) |
| ***H01R 12/70*** | (2011.01) |

(52) U.S. Cl.
CPC ..... *H01R 12/732* (2013.01); *H01R 12/7005* (2013.01); *H01R 12/727* (2013.01); *H01R 13/424* (2013.01); *H01R 13/502* (2013.01)

(58) Field of Classification Search
CPC ..... H01R 9/096; H01R 13/28; H01R 31/08; H01R 23/7073; Y02E 60/12; H05K 7/1478
USPC ..... 439/65, 287, 500, 507, 660, 928
See application file for complete search history.

(56) References Cited

U.S. PATENT DOCUMENTS

| | | | | |
|---|---|---|---|---|
| 4,060,295 A * | 11/1977 | Tomkiewicz | ..... | H01R 12/83 439/55 |
| 4,695,112 A * | 9/1987 | Maston | ..... | H01R 12/79 439/328 |
| 4,938,701 A * | 7/1990 | Heberling | ..... | H01R 12/732 439/327 |
| 6,764,344 B2 * | 7/2004 | Maiers | ..... | G11B 25/043 439/629 |
| 7,488,200 B2 * | 2/2009 | Yamamoto | ..... | H01R 12/52 439/511 |
| 7,802,994 B1 * | 9/2010 | Chen | ..... | H01R 12/58 439/65 |

(Continued)

*Primary Examiner* — Thanh Tam T Le
(74) *Attorney, Agent, or Firm* — Chun-Ming Shih; LanWay IPR Services

(57) ABSTRACT

A connector assembly and a jumper connector thereof are provided. The jumper connector includes a first jumper connector body case for being coupled to a first board edge connector, a second jumper connector body case for being coupled to a second board edge connector, and conductive terminals. The first and second jumper connector body cases are coupled to each other to form an internal receiving space for accommodating the conductive terminals, and the conductive terminals are movable to correspond in position to the first and second board edge connectors respectively. By such structural design, even if circuit boards incur problems like poor processing quality or position offset, the jumper connector according to the present invention can still effectively bridge and join the board edge connectors on the circuit boards, thereby desirably accomplishing electrical connection between multiple circuit boards on electronic equipment.

11 Claims, 14 Drawing Sheets

(56) References Cited

U.S. PATENT DOCUMENTS

| | | | | |
|---|---|---|---|---|
| 7,841,860 | B1 * | 11/2010 | Chen | H01R 13/2442<br>439/513 |
| 7,874,845 | B1 * | 1/2011 | Tang | H01R 13/113<br>439/65 |
| 7,959,445 | B1 * | 6/2011 | Daily | H01R 12/716<br>439/65 |
| 7,963,796 | B2 * | 6/2011 | Sypolt | H01R 12/58<br>439/511 |
| 8,206,159 | B2 * | 6/2012 | Naito | H01R 12/7082<br>439/65 |
| 8,353,726 | B2 * | 1/2013 | Zhang | H01R 12/721<br>439/629 |
| 8,475,000 | B2 * | 7/2013 | Tamai | F21V 23/06<br>362/249.02 |
| 8,651,886 | B2 * | 2/2014 | Tai | H01R 12/732<br>439/345 |
| 8,721,350 | B2 * | 5/2014 | Liu | H01R 13/6315<br>439/65 |
| 8,727,813 | B2 * | 5/2014 | Yang | H01R 12/732<br>439/500 |
| 8,986,020 | B2 * | 3/2015 | Ishii | H01R 11/01<br>439/511 |

* cited by examiner

CONNECTOR ASSEMBLY AND JUMPER CONNECTOR THEREOF

CROSS-REFERENCE TO RELATED APPLICATIONS

This application claims the priority of Republic of China Patent Application No. 107147139 filed on Dec. 26, 2018, respectively, in the State Intellectual Property Office of the R.O.C., the disclosure of which is incorporated herein by reference.

BACKGROUND OF THE INVENTION

Field of the Invention

The present invention relates to a connector field, and more particularly, relates to a connector assembly and a jumper connector thereof, for successfully achieving electrical connection between a plurality of circuit boards provided on electronic equipment.

Descriptions of the Related Art

Electronic equipment, such as LED light, is usually mounted with a plurality of essential circuit boards that must be electrically connected to each other. A jumper connector is normally used to bridge and join board edge connectors on the circuit boards to form such electrical connection between the circuit boards. The circuit boards however often incur problems like poor processing quality or position offset. Either one causes failure in the function of the jumper connector as it is not able to be perfectly aligned with the board edge connectors on the circuit boards and thus not able to bridge and join them as expected. Without doubt, no successful electrical connection between those circuit boards on the electronic equipment is achieved.

Therefore, how to provide a jumper connector for effectively bridging and joining board edge connectors on circuit boards to electrically connect the circuit boards of electronic equipment successfully, which can address the above issues in the conventional technology, is an important task in the art.

SUMMARY OF THE INVENTION

In view of the above drawbacks in the conventional technology, a connector assembly and jumper connector thereof is provided in the invention, it can be used to solve circuit boards incur problems like poor processing quality or position offset, thereby desirably accomplishing electrical connection between multiple circuit boards on electronic equipment.

The jumper connector is provided in the invention. The jumper connector having two sides respectively coupled to a first board edge connector and a second board edge connector, the first board edge connector including a first board edge connector body case and first board edge connector blade conductors, the second board edge connector including a second board edge connector body case and second board edge connector blade conductors, wherein the first board edge connector body case has a third guiding structure, the first board edge connector blade conductors are embedded in the first board edge connector body case, the second board edge connector body case has a fourth guiding structure, and the second board edge connector blade conductors are embedded in the second board edge connector body case, the jumper connector including: a first jumper connector body case for being coupled to the first board edge connector body case, the first jumper connector body case including a first guiding structure, a first internal space, a first engaging structure, a first inserting structure and a first exposing structure; a second jumper connector body case for being coupled to the second board edge connector body case, the second jumper connector body case including a second guiding structure, a second internal space, a second engaging structure, a second inserting structure and a second exposing structure; and conductive terminals, each of which has two ends bent in U-shape to form a first attaching portion and a second attaching portion respectively; wherein, the first and second engaging structures are capable of being engaged with each other to join the first and second jumper connector body cases together so as to integrate the first and second internal spaces to form an integral receiving space; the conductive terminals are capable of being accommodated in the integral receiving space, with the first and second attaching portions being exposed by the first and second exposing structures respectively; the first and third guiding structures are capable of providing mutual guidance to allow the first attaching portions to move relative to the first board edge connector in a first Z direction to be attached to the first board edge connector blade conductors, and further allow the first attaching portions to move relative to the first board edge connector in a first Y direction to adjust relative positions of the first attaching portions and the first board edge connector; the second and fourth guiding structures are capable of providing mutual guidance to allow the second attaching portions to move relative to the second board edge connector in a second Z direction to be attached to the second board edge connector blade conductors, and further allow the second attaching portions to move relative to the second board edge connector in a second Y direction to adjust relative positions of the second attaching portions and the second board edge connector; and the first and second inserting structures are capable of being inserted to each other to allow relative movement of the first and second jumper connector body cases in an X direction, so as to align the first and second attaching portions with the first and second board edge connector blade conductors respectively.

Selectively, the jumper connector according to the present invention, wherein the first attaching portions have first gripping parts for gripping the first board edge connector blade conductors to keep the first attaching portions attached to the first board edge connector blade conductors, and the second attaching portions have second gripping parts for gripping the second board edge connector blade conductors to keep the second attaching portions attached to the second board edge connector blade conductors.

Selectively, the jumper connector according to the present invention, wherein the first attaching portions have first abutting parts for abutting the first jumper connector body case, to allow the first attaching portions to turn using the first jumper connector body case as a pivot to be aligned with the first board edge connector blade conductors, and the second attaching portions have second abutting parts for abutting the second jumper connector body case, to allow the second attaching portions to turn using the second jumper connector body case as a pivot to be aligned with the second board edge connector blade conductors.

Selectively, the jumper connector according to the present invention, wherein under the first attaching portions there are formed first inserting openings for allowing the first board edge connector blade conductors to be inserted upwards into the first attaching portion so as to couple the first attaching portions to the first board edge connector blade conductors, and under the second attaching portions there are formed second inserting openings for allowing the second board edge connector blade conductors to be inserted upwards into the second attaching portions so as to couple the second attaching portions to the second board edge connector blade conductors.

Selectively, the jumper connector according to the present invention, wherein the first jumper connector body case further includes a first blocking structure capable of being in contact with the second inserting structure to block relative movement of the first and second jumper connector body cases in a third Y direction or a third Z direction, and the second jumper connector body case further includes a second blocking structure capable of being in contact with the first inserting structure to block relative movement of the first and second jumper connector body cases in a fourth Y direction or a fourth Z direction.

Selectively, the jumper connector according to the present invention, wherein the first jumper connector body case further includes a first spacing structure for providing room for the second engaging structure to allow relative movement of the first and second jumper connector body cases in the X direction, and the second jumper connector body case further includes a second spacing structure for providing room for the first engaging structure to allow relative movement of the first and second jumper connector body cases in the X direction.

Selectively, the jumper connector according to the present invention, wherein the first jumper connector body case further includes a first force applying plate extended above the first board edge connector body case, for allowing the first jumper connector body case to move by a force applied to the first force applying plate, and the second jumper connector body case further includes a second force applying plate extended above the second board edge connector body case, for allowing the second jumper connector body case to move by a force applied to the second force applying plate, wherein the first guiding structure is formed on a side of the first force applying plate facing the first board edge connector body case, and the second guiding structure is formed on a side of the second force applying plate facing the second board edge connector body case.

A connector assembly is also provided in the invention, including: a first board edge connector including a first board edge connector body case and first board edge connector blade conductors, wherein the first board edge connector body case has a third guiding structure, and the first board edge connector blade conductors are embedded in the first board edge connector body case; a second board edge connector including a second board edge connector body case and second board edge connector blade conductors, wherein the second board edge connector body case has a fourth guiding structure, and the second board edge connector blade conductors are embedded in the second board edge connector body case; and a jumper connector having two sides respectively coupled to the first board edge connector and the second board edge connector, the jumper connector including: a first jumper connector body case for being coupled to the first board edge connector body case, the first jumper connector body case including a first guiding structure, a first internal space, a first engaging structure, a first inserting structure and a first exposing structure; a second jumper connector body case for being coupled to the second board edge connector body case, the second jumper connector body case including a second guiding structure, a second internal space, a second engaging structure, a second inserting structure and a second exposing structure; and conductive terminals, each of which has two ends bent in U-shape to form an elastic first attaching portion and an elastic second attaching portion respectively; wherein, the first and second engaging structures are capable of being engaged with each other to join the first and second jumper connector body cases together so as to integrate the first and second internal spaces to form an integral receiving space; the conductive terminals are capable of being accommodated in the integral receiving space, with the first and second attaching portions being exposed by the first and second exposing structures respectively; the first and third guiding structures are capable of providing mutual guidance to allow the first attaching portions to move relative to the first board edge connector in a first Z direction to be attached to the first board edge connector blade conductors, and further allow the first attaching portions to move relative to the first board edge connector in a first Y direction to adjust relative positions of the first attaching portions and the first board edge connector; the second and fourth guiding structures are capable of providing mutual guidance to allow the second attaching portions to move relative to the second board edge connector in a second Z direction to be attached to the second board edge connector blade conductors, and further allow the second attaching portions to move relative to the second board edge connector in a second Y direction to adjust relative positions of the second attaching portions and the second board edge connector; and the first and second inserting structures are capable of being inserted to each other to allow relative movement of the first and second jumper connector body cases in an X direction, so as to align the first and second attaching portions with the first and second board edge connector blade conductors respectively.

Selectively, the jumper connector according to the present invention, wherein the first and third guiding structures are respectively composed of structurally matching convex portions and concave portions, wherein above the third guiding structure there is formed a first entry for allowing the first guiding structure to downwards enter the third guiding structure so as to achieve mutual guidance between the first and third guiding structures, and the second and fourth guiding structures are respectively composed of structurally matching convex portions and concave portions, wherein above the fourth guiding structure there is formed a second entry for allowing the second guiding structure to downwards enter the fourth guiding structure so as to achieve mutual guidance between the second and fourth guiding structures.

Selectively, the jumper connector according to the present invention, wherein the first board edge connector body case further includes a third side assembling structure, the second board edge connector body case further includes a fourth side assembling structure, the first jumper connector body case further includes a first side assembling structure, and the second jumper connector body case further includes a second side assembling structure, wherein, the first and third side assembling structures are capable of being assembled together to guide the first jumper connector body case to enter the first board edge connector body case until the first guiding structure touches the third guiding structure, and the second and fourth side assembling structures are capable of being assembled together to guide the second jumper connector body case to enter the second board edge connector body case until the second guiding structure touches the fourth guiding structure.

Selectively, the jumper connector according to the present invention, wherein the first and third side assembling structures are respectively composed of structurally matching convex portions and concave portions, wherein above the third side assembling structure there is formed a first opening for allowing the first side assembling structure to downwards enter the third side assembling structure so as to assemble the first and third side assembling structures, and the second and fourth side assembling structures are respectively composed of structurally matching convex portions and concave portions, wherein above the fourth side assembling structure there is formed a second opening for allowing the second side assembling structure to downwards enter the fourth side assembling structure so as to assemble the second and fourth side assembling structures, wherein the first opening is taller than the first entry, and the second opening is taller than the second entry.

In comparison to prior arts, a primary object of the present invention is to provide a connector assembly and a jumper connector thereof, wherein first attaching portions of conductive terminals of the jumper connector can move relative to a first board edge connector in a first Z direction or a first Y direction to adjust relative positions of the first attaching portions and the first board edge connector. Further, second attaching portions of the conductive terminals of the jumper connector can move relative to a second board edge connector in a second Z direction or a second Y direction to adjust relative positions of the second attaching portions and the second board edge connector. By sliding to form insertion between first and second inserting structures of the jumper connector, first and second jumper connector body cases of the jumper connector can move relative to each other in an X direction to allow the first and second attaching portions to be respectively aligned with and attached to blade conductors of the first and second board edge connectors. With such structural design, even if circuit boards incur problems like poor processing quality or position offset, the jumper connector according to the present invention can still effectively bridge and join the board edge connectors on the circuit boards, thereby desirably accomplishing electrical connection between multiple circuit boards on electronic equipment.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
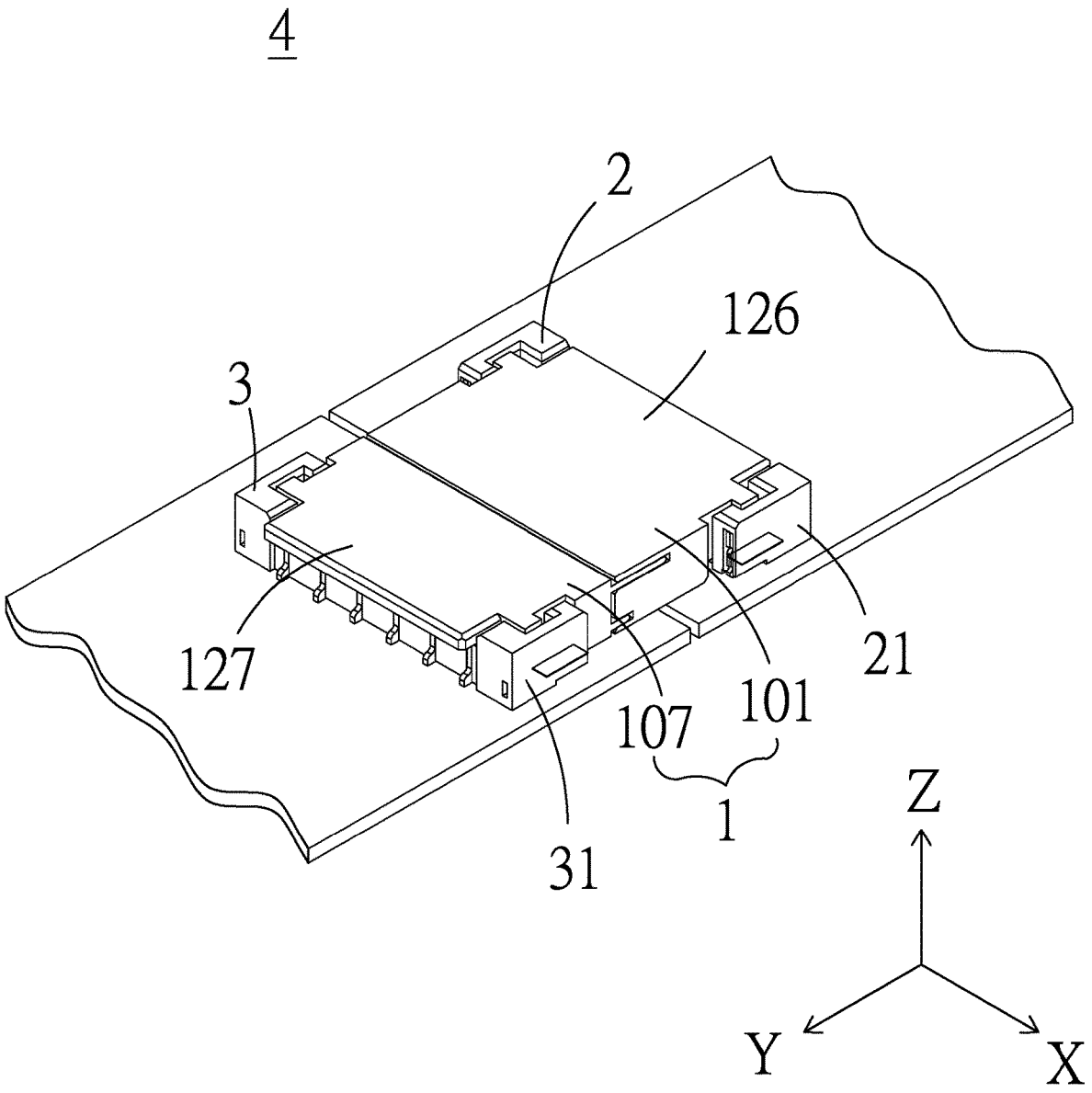
FIG. 1 is a schematic diagram showing the appearance of a connector assembly according to the present invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Referring to FIGS. 1 to 14, as shown in FIG. 1, a connector assembly 4 according to the present invention includes a jumper connector 1, a first board edge connector 2 and a second board edge connector 3.

Figure 2:
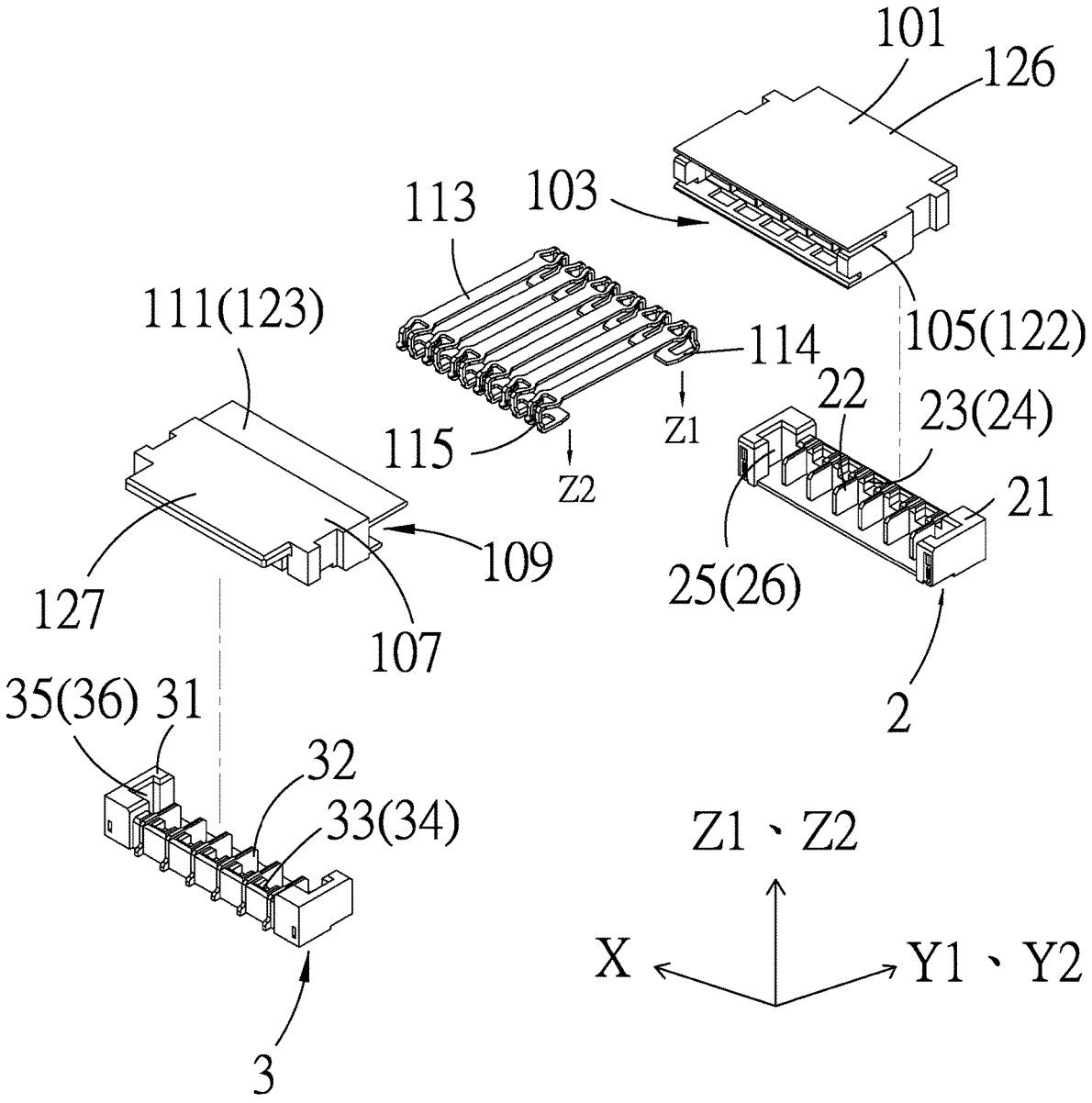
FIG. 2 is a breakdown diagram of the connector assembly shown in FIG. 1 from a first viewing angle.
Figure 3:
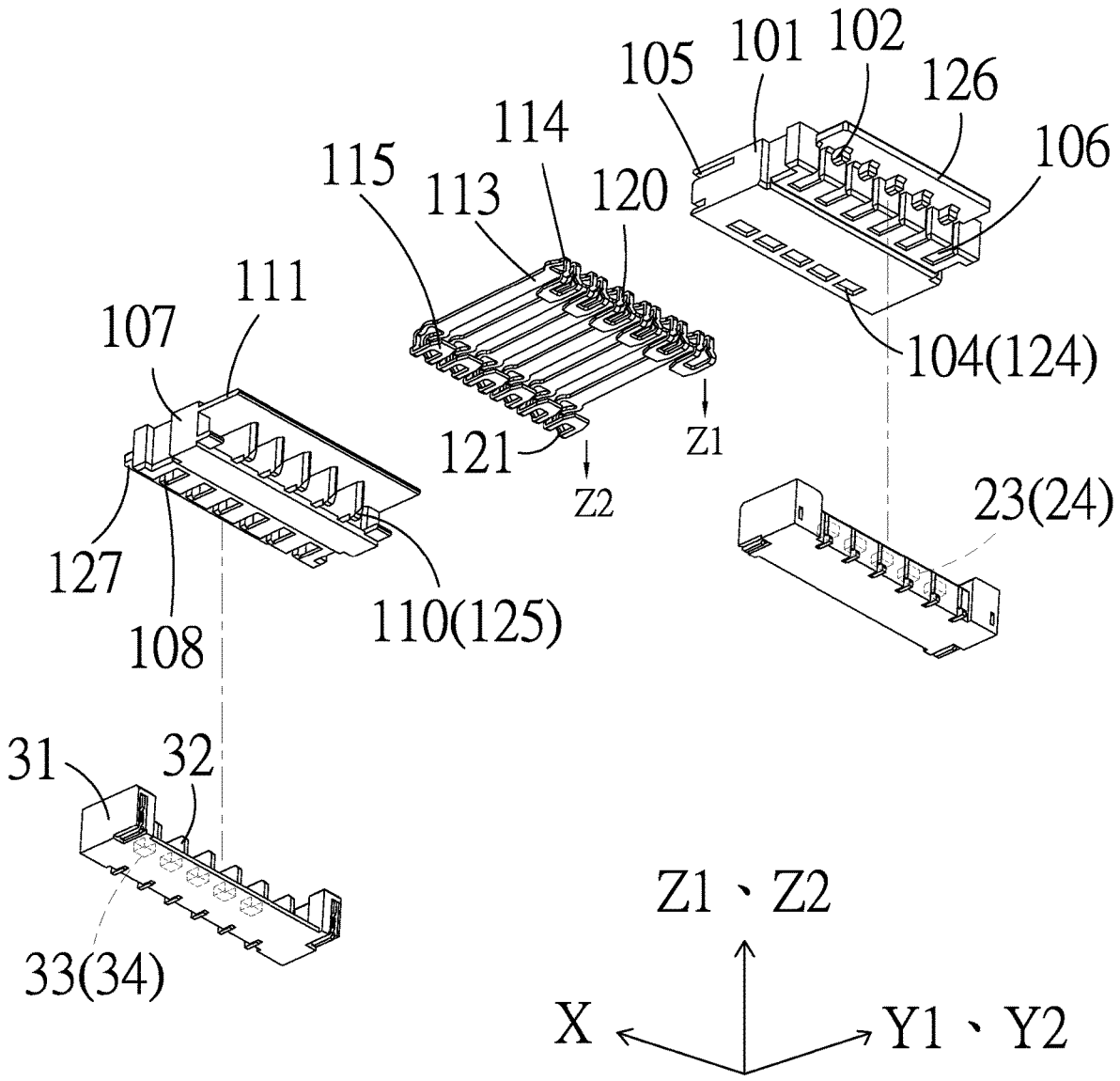
FIG. 3 is a breakdown diagram of the connector assembly shown in FIG. 1 from a second viewing angle.

As shown in FIGS. 2 and 3, the first board edge connector 2 includes a first board edge connector body case 21 and first board edge connector blade conductors 22. The first board edge connector body case 21 has a third guiding structure 23, and the first board edge connector blade conductors 22 are embedded in the first board edge connector body case 21.

The second board edge connector 3 includes a second board edge connector body case 31 and second board edge connector blade conductors 32. The second board edge connector body case 31 has a fourth guiding structure 33, and the second board edge connector blade conductors 32 are embedded in the second board edge connector body case 31. The jumper connector 1 has its two sides coupled to the first and second board edge connectors 2, 3 respectively to form electrical connection between the first and second board edge connectors 2, 3.

In the embodiment shown in FIGS. 10 to 14, the jumper connector 1 includes a first jumper connector body case 101, a second jumper connector body case 107 and conductive terminals 113.

As shown in FIGS. 2, 3 and 10 to 14, the first jumper connector body case 101 can be mounted over and joined to the first board edge connector body case 21 of the first board edge connector 2. The first jumper connector body case 101 includes a first guiding structure 102, a first internal space 103, a first engaging structure 104, a first inserting structure 105 and a first exposing structure 106, wherein the first guiding structure 102 matches the third guiding structure 23 of the first board edge connector body case 21.

Further, the second jumper connector body case 107 can be mounted over and joined to the second board edge connector body case 31. The second jumper connector body case 107 includes a second guiding structure 108, a second internal space 109, a second engaging structure 110, a second inserting structure 111 and a second exposing structure 112. The second guiding structure 108 matches the fourth guiding structure 33 of the second board edge connector body case 31. The second inserting structure 111 matches the first inserting structure 105 of the first jumper connector body case 101. The second engaging structure 110 matches the first engaging structure 104 of the first jumper connector body case 101.

Figure 12:
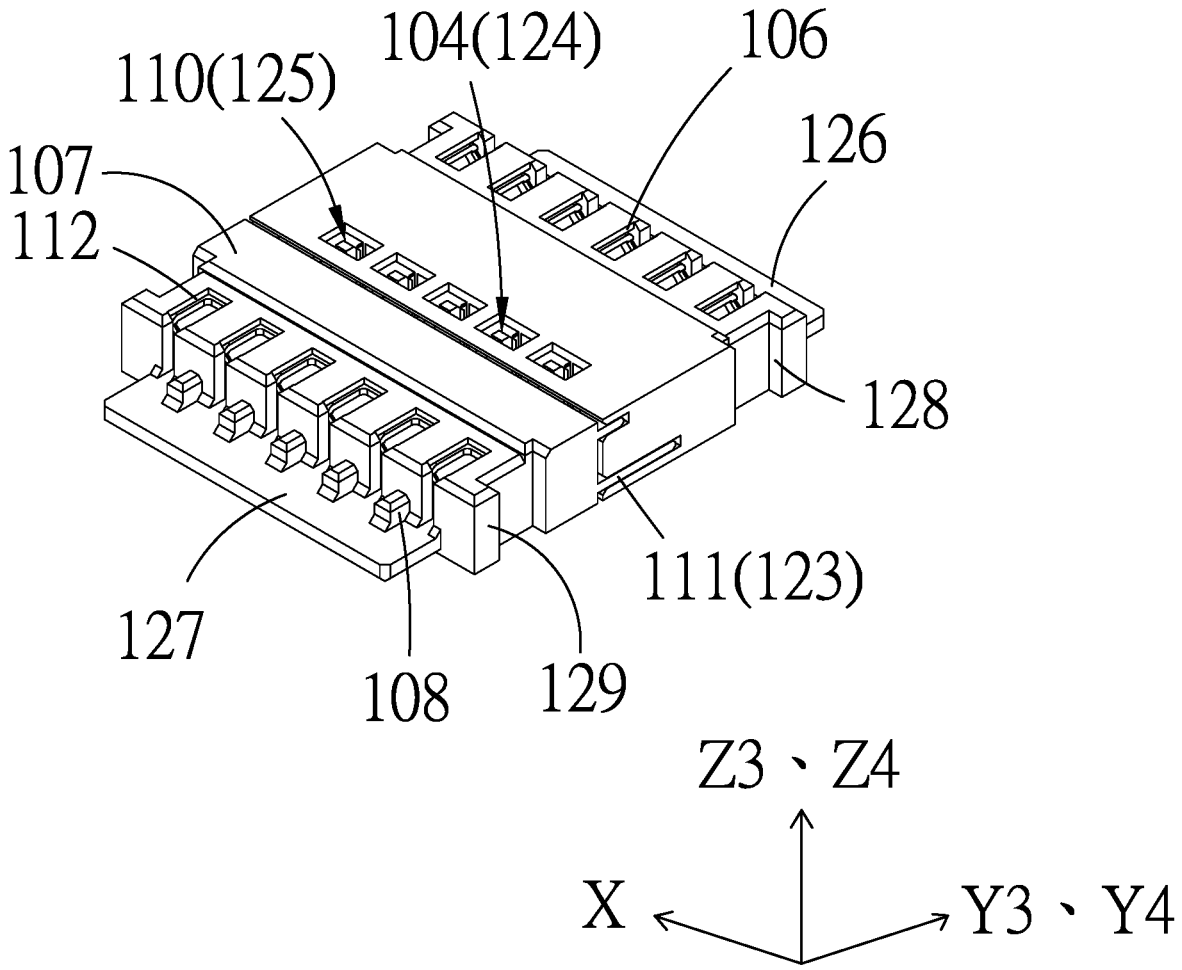
FIG. 12 is a schematic diagram showing a third assembled status of the jumper connector according to the present invention.
Figure 13:
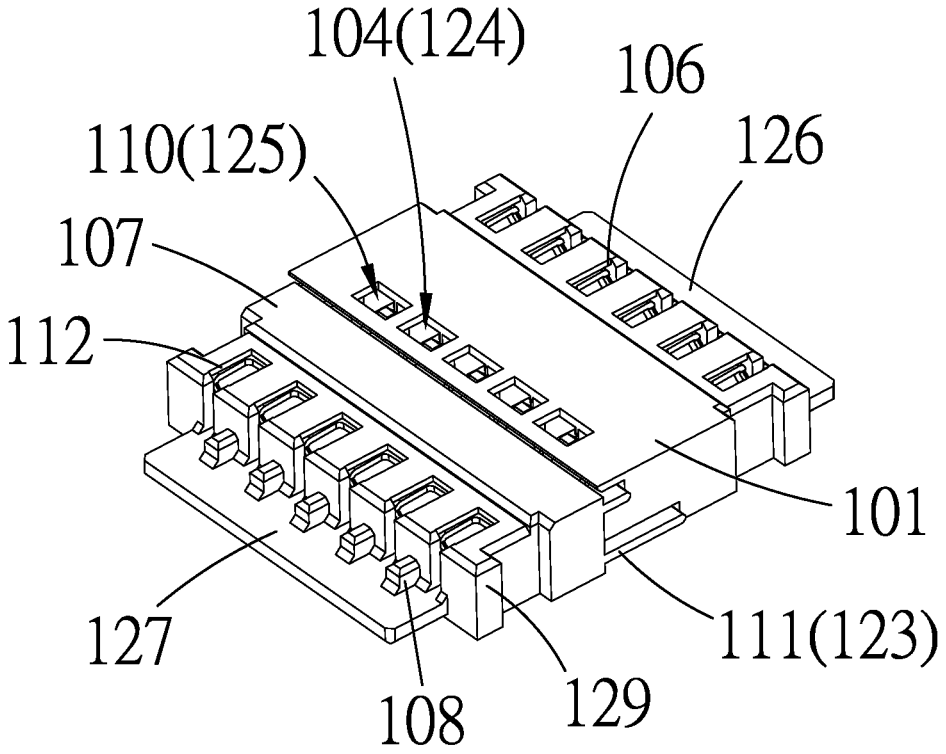
FIG. 13 is a schematic diagram showing relative movement of two body cases of the jumper connector in an X direction according to the present invention.

As shown in FIGS. 12 to 13, the first engaging structure 104 of the first jumper connector body case 101 can be engaged with the second engaging structure 110 of the second jumper connector body case 107, such that the first and second jumper connector body cases 101, 107 are coupled to each other, making the first internal space 103 of the first jumper connector body case 101 and the second internal space 109 of the second jumper connector body case 107 integrally form a receiving space.

Figure 4:
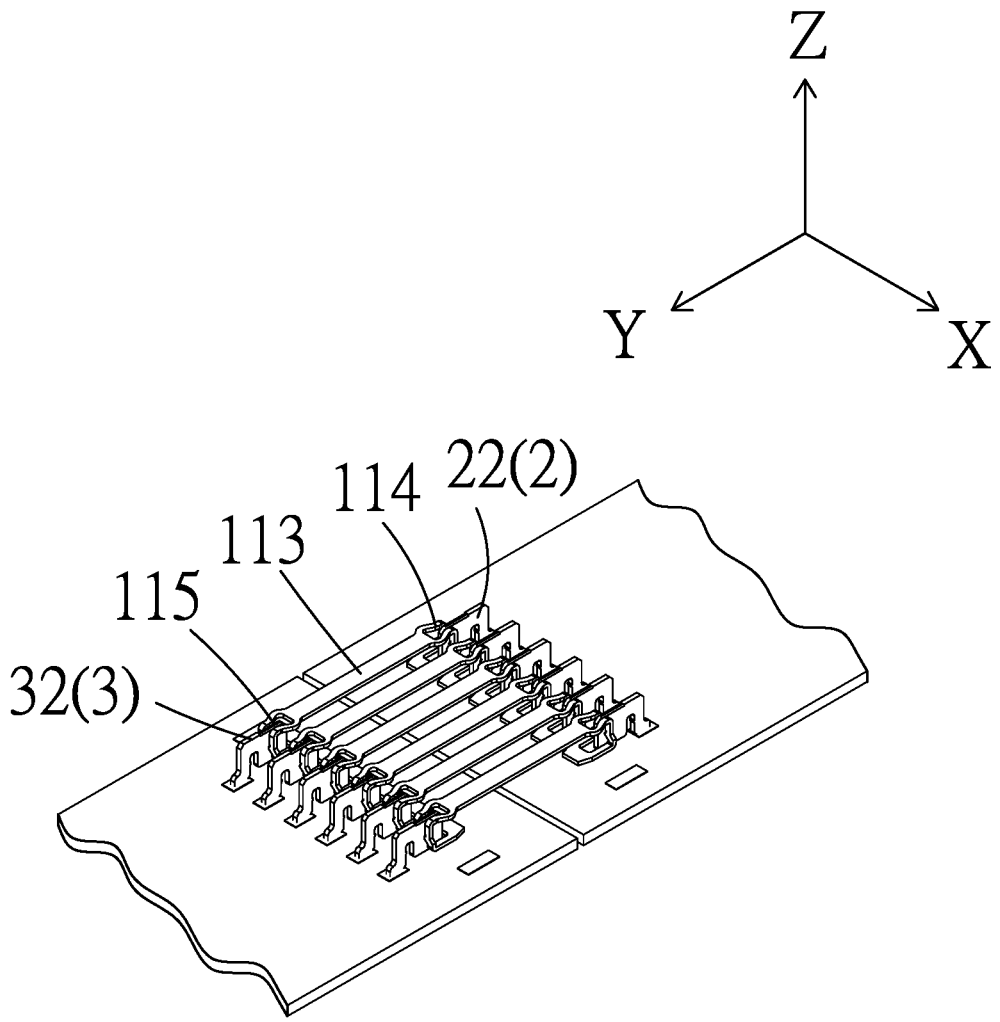
FIG. 4 is a schematic diagram of the connector assembly shown in FIG. 1 with some parts thereof omitted (not shown).
Figure 5:
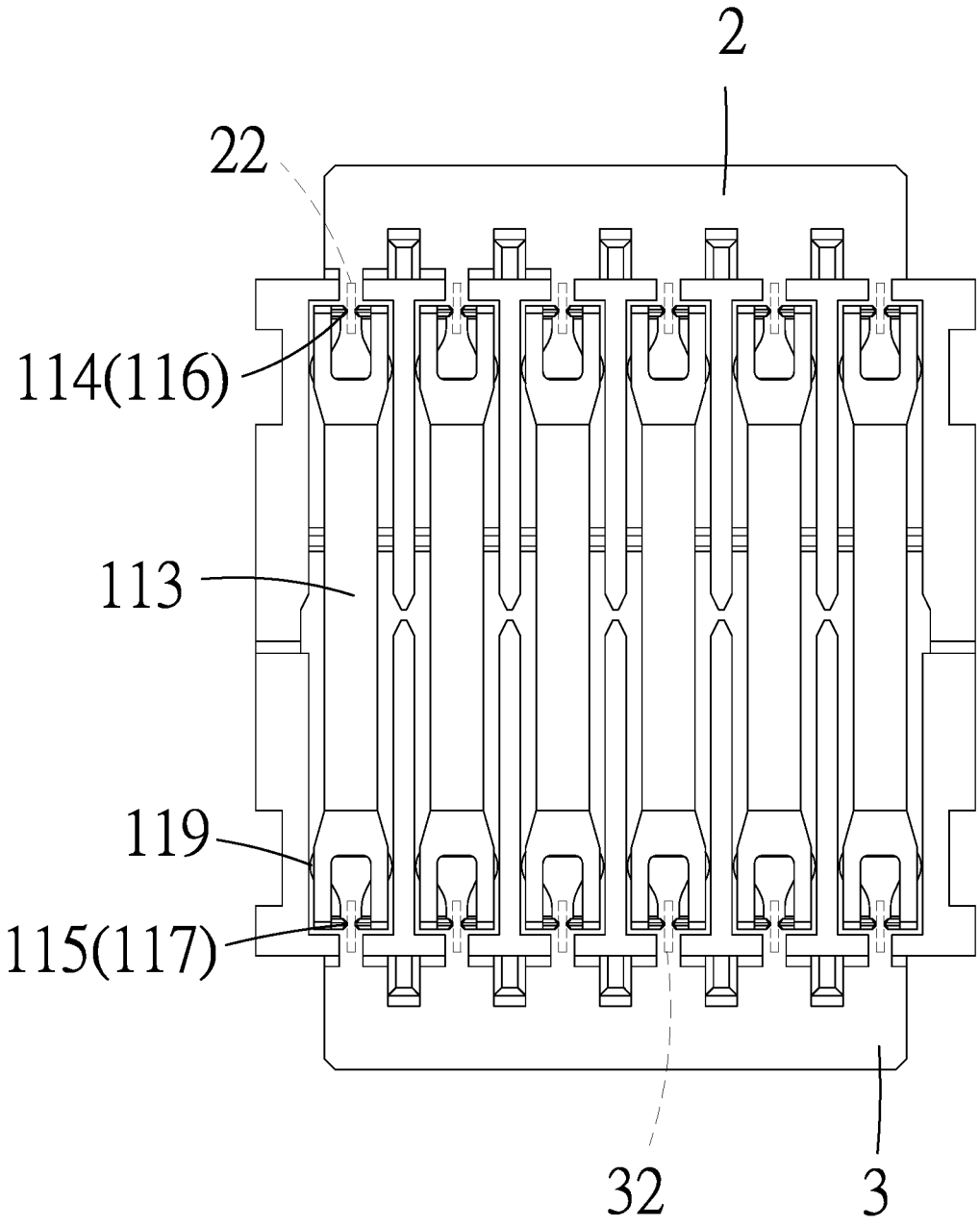
FIG. 5 is a schematic diagram showing a first usage status of the connector assembly shown in FIG. 1.
Figure 6:
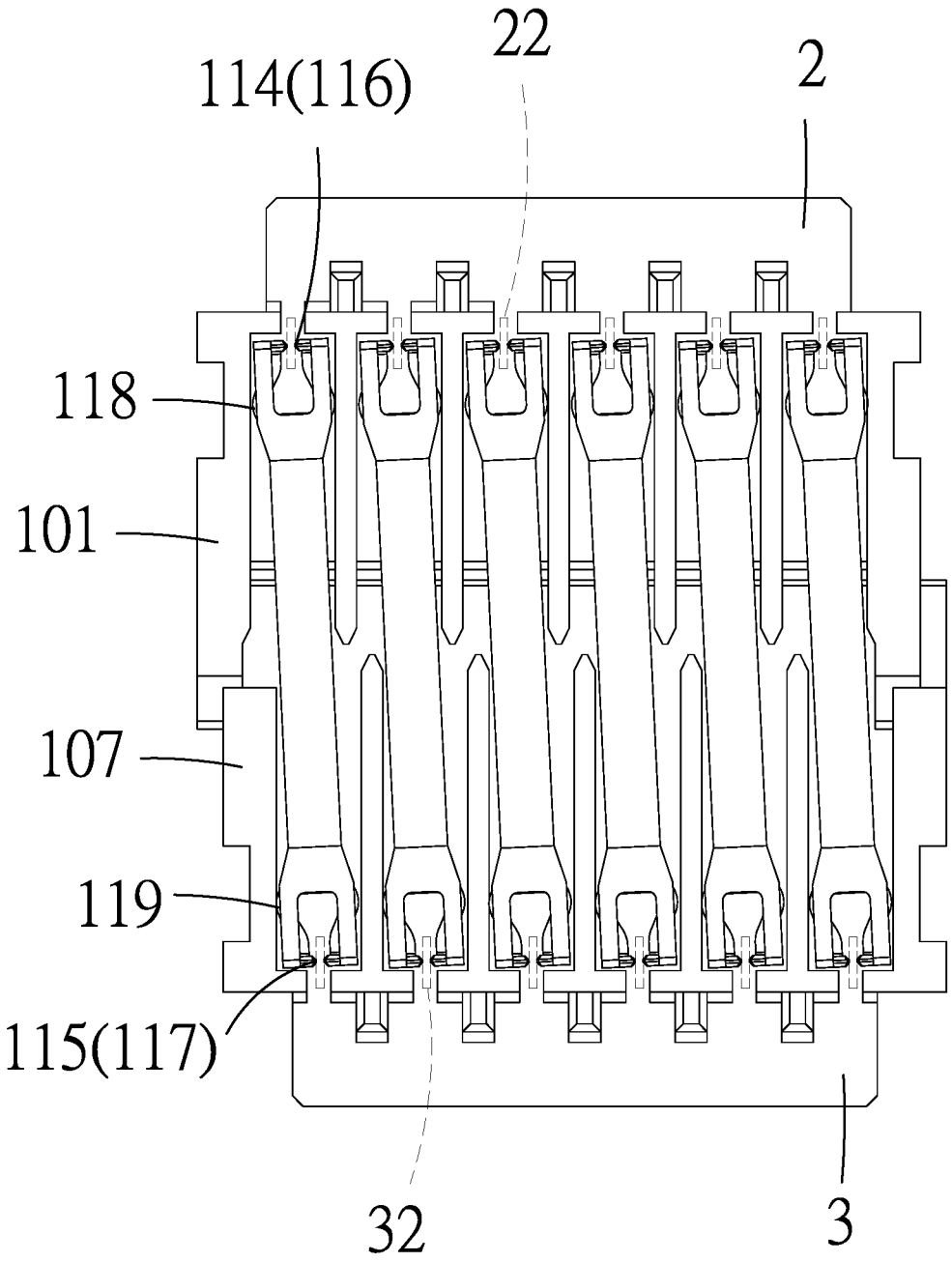
FIG. 6 is a schematic diagram showing a second usage status of the connector assembly shown in FIG. 1.
Figure 14:
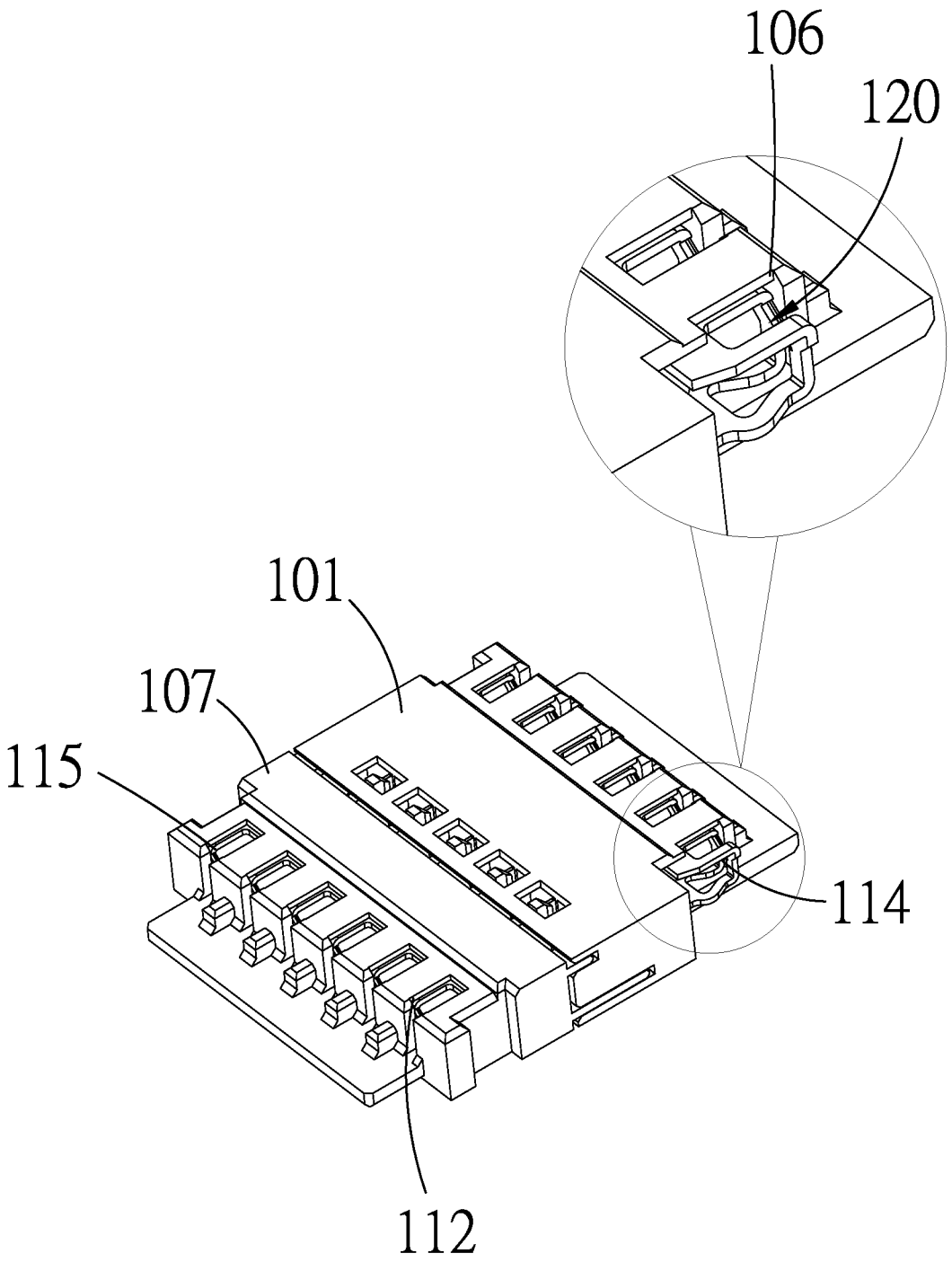
FIG. 14 is a schematic diagram of the jumper connector shown in FIG. 11 with some parts thereof omitted (not shown).

Moreover, as shown in FIGS. 4 to 6, each of the conductive terminals 113 according to the present invention has two ends bent to form a first attaching portion 114 and a second attaching portion 115 respectively, each of which is made of a U-shaped elastic structure. The conductive terminals 113 are accommodated in the receiving space (shown in FIG. 2) integrally formed by the first and second internal spaces 103, 109, wherein the first attaching portions 114 of the conductive terminals 113 are exposed by the first exposing structure 106 of the first jumper connector body case 101, and the second attaching portions 115 thereof are exposed by the second exposing structure 112 of the second jumper connector body case 107 (as shown in FIGS. 12 to 14).

In the embodiment shown in FIGS. 2 to 6, the first and third guiding structures 102, 23 can provide mutual guidance to make the jumper connector 1 move relative to the first board edge connector 2 in a first Z direction Z1 so as to move the first attaching portions 114 relative to the first board edge connector 2 in the first Z direction Z1 and attach them to the first board edge connector blade conductors 22 of the first board edge connector 2, and further to make the first attaching portions 114 move relative to the first board edge connector 2 in a first Y direction Y1 so as to adjust relative positions of the first attaching portions 114 and the first board edge connector 2, such that electrical connection between the first attaching portions 114 of the conductive terminals 113 and the first board edge connector 2 is accomplished.

Moreover, the second and fourth guiding structures 108, 33 can provide mutual guidance to make the jumper connector 1 move relative to the second board edge connector 3 in a second Z direction Z2 so as to move the second attaching portions 115 relative to the second board edge connector 3 in the second Z direction Z2 and attach them to the second board edge connector blade conductors 32, and further to make the second attaching portions 115 move relative to the second board edge connector 3 in a second Y direction Y2 so as to adjust relative positions of the second attaching portions 115 and the second board edge connector 3, such that electrical connection between the second attaching portions 115 of the conductive terminals 113 and the second board edge connector 3 is accomplished.

In the embodiment shown in FIG. 3, the first and third guiding structures 102, 23 are respectively composed of structurally matching convex portions and concave portions. There is further formed a first entry 24 above the third guiding structure 23, and the first guiding structure 102 can downwards enter the third guiding structure 23 through the first entry 24, to thereby allow mutual guidance between the first and third guiding structures 102, 23. Moreover, the second and fourth guiding structures 108, 33 are respectively composed of structurally matching convex portions and concave portions. There is further formed a second entry 34 above the fourth guiding structure 33, and the second guiding structure 108 can downwards enter the fourth guiding structure 33 through the second entry 34, to thereby allow mutual guidance between the second and fourth guiding structures 108, 33.

In the embodiment shown in FIGS. 3 to 9, the first board edge connector body case 21 further includes a third side assembling structure 25, and the second board edge connector body case 31 further includes a fourth side assembling structure 35. Correspondingly, the first jumper connector body case 101 further includes a first side assembling structure 128, and the second jumper connector body case 107 further includes a second side assembling structure 129. The first jumper connector body case 101 can be guided by assembling the first and third side assembling structures 128, 25 to enter the first board edge connector body case 21 in a way that the first guiding structure 102 is able to touch the third guiding structure 23, such that misalignment during the process of the first jumper connector body case 101 entering the first board edge connector body case 21 is avoided. Alternatively, the second jumper connector body case 107 can be guided by assembling the second and fourth side assembling structures 129, 35 to enter the second board edge connector body case 31 in a way that the second guiding structure 108 is able to touch the fourth guiding structure 33, such that misalignment during the process of the second jumper connector body case 107 entering the second board edge connector body case 31 is avoided.

In the embodiment shown in FIGS. 2 to 9, the first and third side assembling structures 128, 25 are respectively composed of structurally matching convex portions and concave portions. There is further formed a first opening 26 above the third side assembling structure 25, and the first side assembling structure 128 can downwards enter the third side assembling structure 25 through the first opening 26, so as to assemble the first and third side assembling structures 128, 25.

Moreover, the second and fourth side assembling structures 129, 35 are respectively composed of structurally matching convex portions and concave portions. There is further formed a second opening 36 above the fourth side assembling structure 35, and the second side assembling structure 129 can downwards enter the fourth side assembling structure 35 through the second opening 36, so as to assemble the second and fourth side assembling structures 129, 35. The first opening 26 of the third side assembling structure 25 is taller than the first entry 24 of the third guiding structure 23, such that the third side assembling structure 25 can guide the first guiding structure 102 to smoothly approach the third guiding structure 23. The second opening 36 of the fourth side assembling structure 35 is taller than the second entry 34 of the fourth guiding structure 33, such that the fourth side assembling structure 35 can guide the second guiding structure 108 to smoothly approach the fourth guiding structure 33.

If there is misalignment between the first and second board edge connectors 2, 3, by sliding and inserting the first inserting structure 105 and the second inserting structure 111 of the jumper connector 1 to each other, the first and second jumper connector body cases 101, 107 can move relative to each other in an X direction X in a way of forming misalignment between the first and second jumper connector body cases 101, 107 in the X direction X, so as to allow the first and second attaching portions 114, 115 to respectively be aligned with the first and second board edge connector blade conductors 22, 32 (as shown in FIGS. 6 and 13) and to respectively be attached precisely to predetermined positions of the first and second board edge connectors 2, 3. Thus, even if circuit boards incur problems like poor processing quality or position offset, the first and second attaching portions 114, 115 of the conductive terminals 113 of the jumper connector 1 according to the present invention can still be effectively coupled to the first and second board edge connectors 2, 3 respectively, thereby desirably accomplishing successful electrical connection between multiple circuit boards on electronic equipment.

Further as shown in FIGS. 5 to 6, the first attaching portions 114 can be formed with first gripping parts 116 for gripping the first board edge connector blade conductors 22 to keep the first attaching portions 114 of the conductive terminals 113 attached to the first board edge connector blade conductors 22 of the first board edge connector 2. Moreover, the second attaching portions 115 can be formed with second gripping parts 117 for gripping the second board edge connector blade conductors 32 to keep the second attaching portions 115 of the conductive terminals 113 attached to the second board edge connector blade conductors 32 of the second board edge connector 3.

In the embodiment shown in FIG. 6, the first attaching portions 114 can be formed with first abutting parts 118 for abutting the first jumper connector body case 101 in a way of allowing the first attaching portions 114 to turn using the first jumper connector body case 101 as a pivot, so as to make the first attaching portions 114 aligned with and successfully attached to the first board edge connector blade conductors 22. Moreover, the second attaching portions 115 can be formed with second abutting parts 119 for abutting the second jumper connector body case 107 in a way of allowing the second attaching portions 115 to turn using the second jumper connector body case 107 as a pivot, so as to make the second attaching portions 115 aligned with and successfully attached to the second board edge connector blade conductors 32.

In the embodiment shown in FIGS. 11 to 14, under the first attaching portions 114 there are formed first inserting openings 120 for allowing the first board edge connector blade conductors 22 to be inserted upwards into the first attaching portions 114, such that the first attaching portions 114 are attached over and to the first board edge connector blade conductors 22. Moreover, under the second attaching portions 115 there are formed second inserting openings 121 for allowing the second board edge connector blade conductors 32 to be inserted upwards into the second attaching portions 115, such that the second attaching portions 115 are attached over and to the second board edge connector blade conductors 32.

Figure 11:
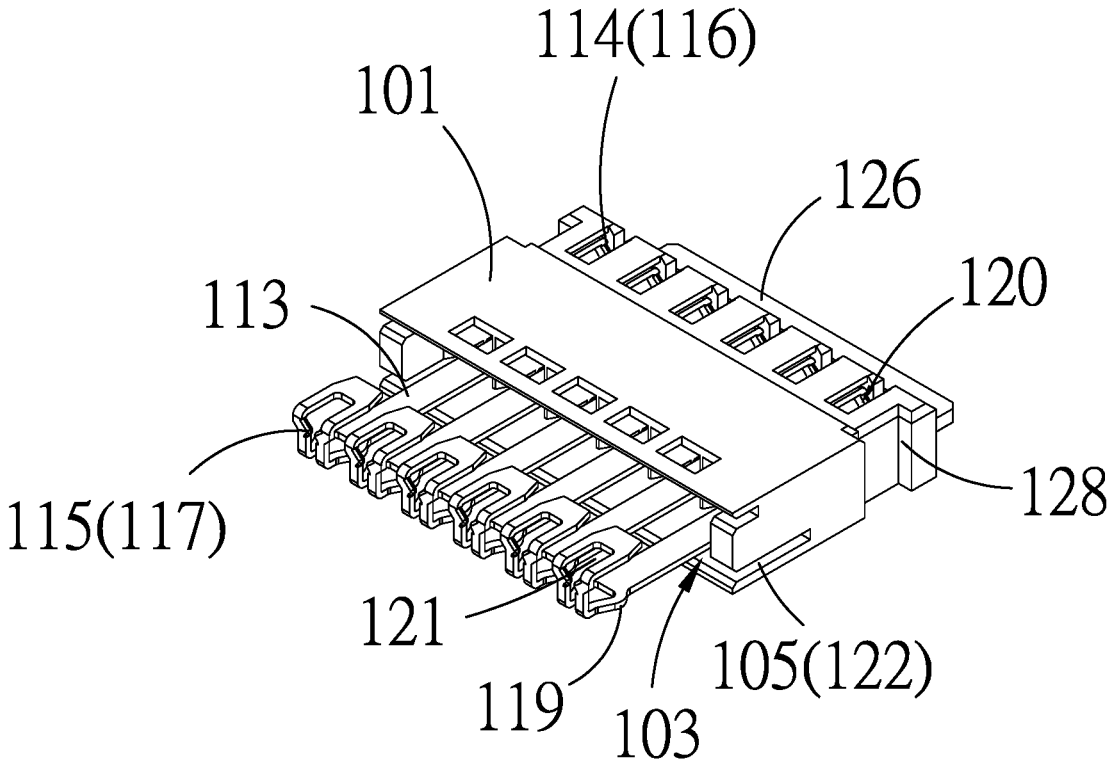
FIG. 11 is a schematic diagram showing a second assembled status of the jumper connector according to the present invention.

In the embodiment shown FIGS. 11 to 13, the first jumper connector body case 101 further includes a first blocking structure 122, wherein the first blocking structure 122 can come into contact with the second inserting structure 111 to block relative movement of the first and second jumper connector body cases 101, 107 in a third Y direction Y3 or a third Z direction Z3. The second jumper connector body case 107 further includes a second blocking structure 123, wherein the second blocking structure 123 can come into contact with the first inserting structure 105 to block relative movement of the first and second jumper connector body cases 101, 107 in a fourth Y direction Y4 or a fourth Z direction Z4.

Figure 10:
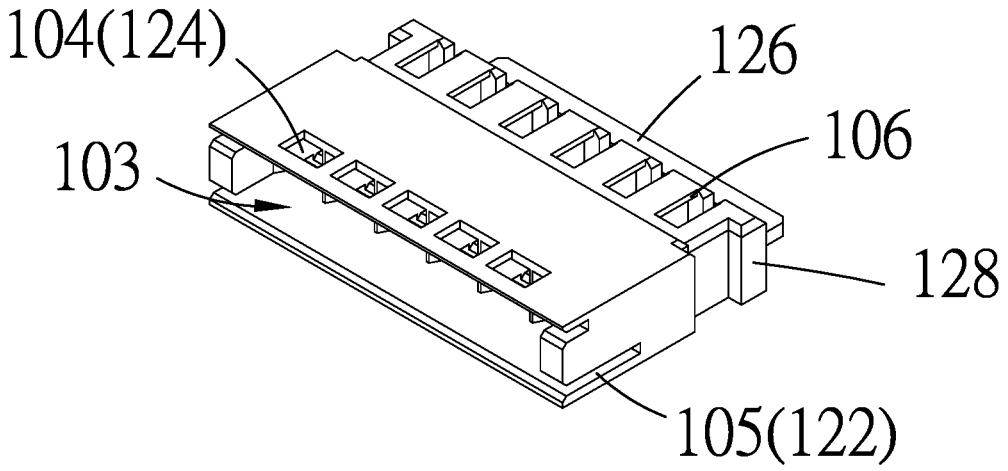
FIG. 10 is a schematic diagram showing a first assembled status of a jumper connector according to the present invention.

As shown in FIGS. 10, 12 and 13, the first jumper connector body case 101 further includes a first spacing structure 124 for providing room for the second engaging structure 110 to allow relative movement of the first and second jumper connector body cases 101, 107 in the X direction X. The second jumper connector body case 107 further includes a second spacing structure 125 for providing room for the first engaging structure 104 to allow relative movement of the first and second jumper connector body cases 101, 107 in the X direction X.

Figure 7:
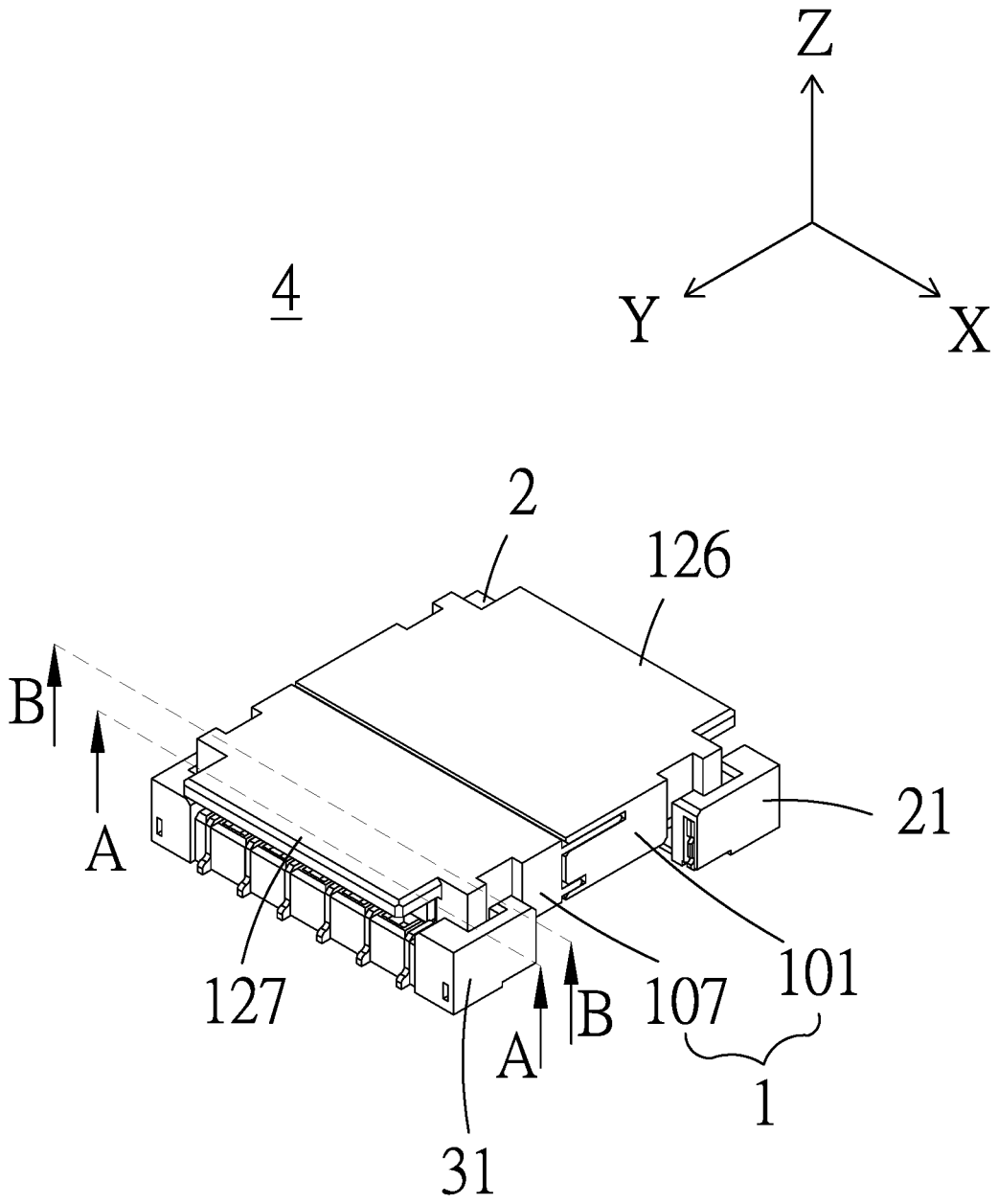
FIG. 7 is a schematic diagram showing an assembled status of the connector assembly shown in FIG. 1.
Figure 8:
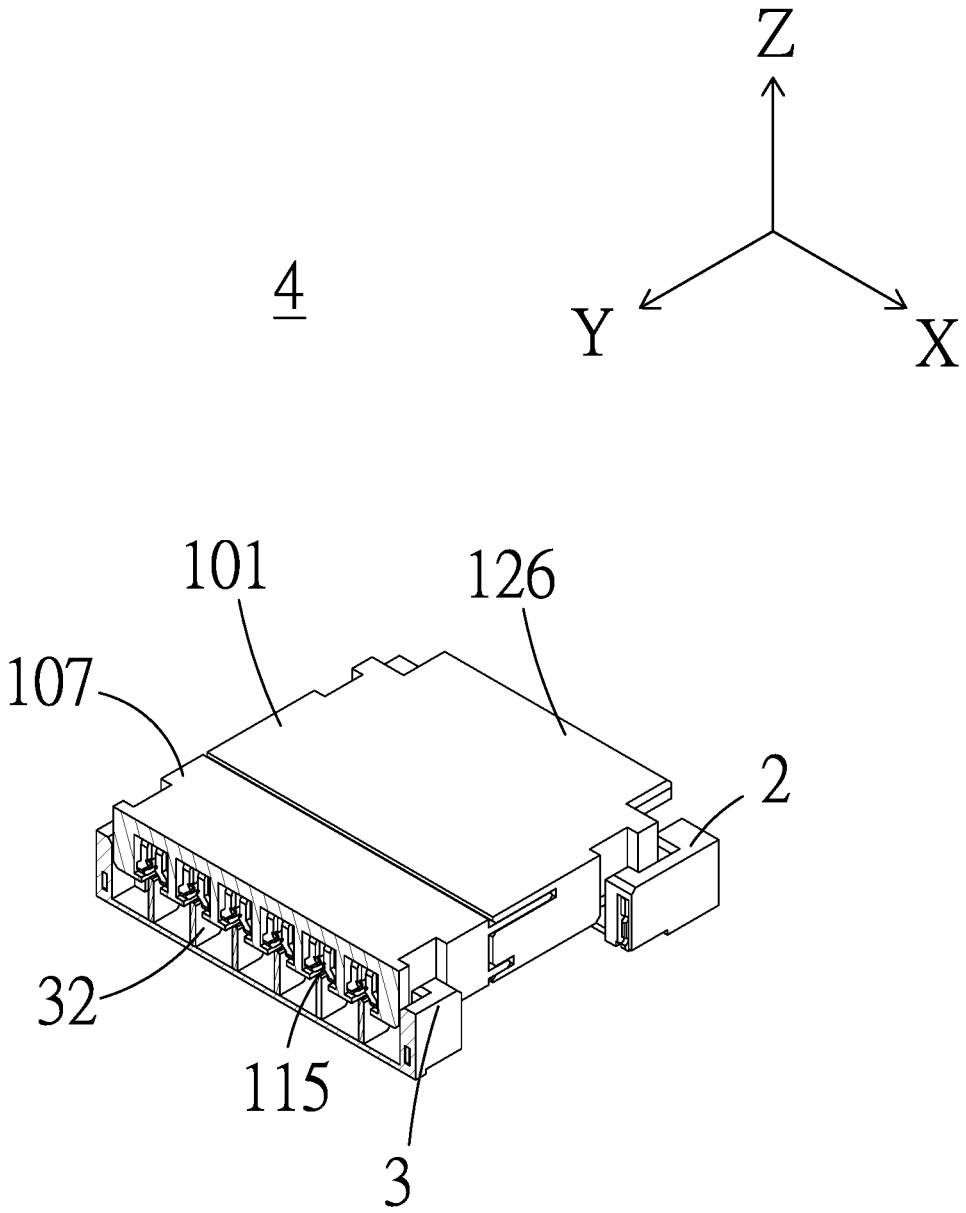
FIG. 8 is a schematic diagram of the connector assembly shown in FIG. 7 cut along line AA.
Figure 9:
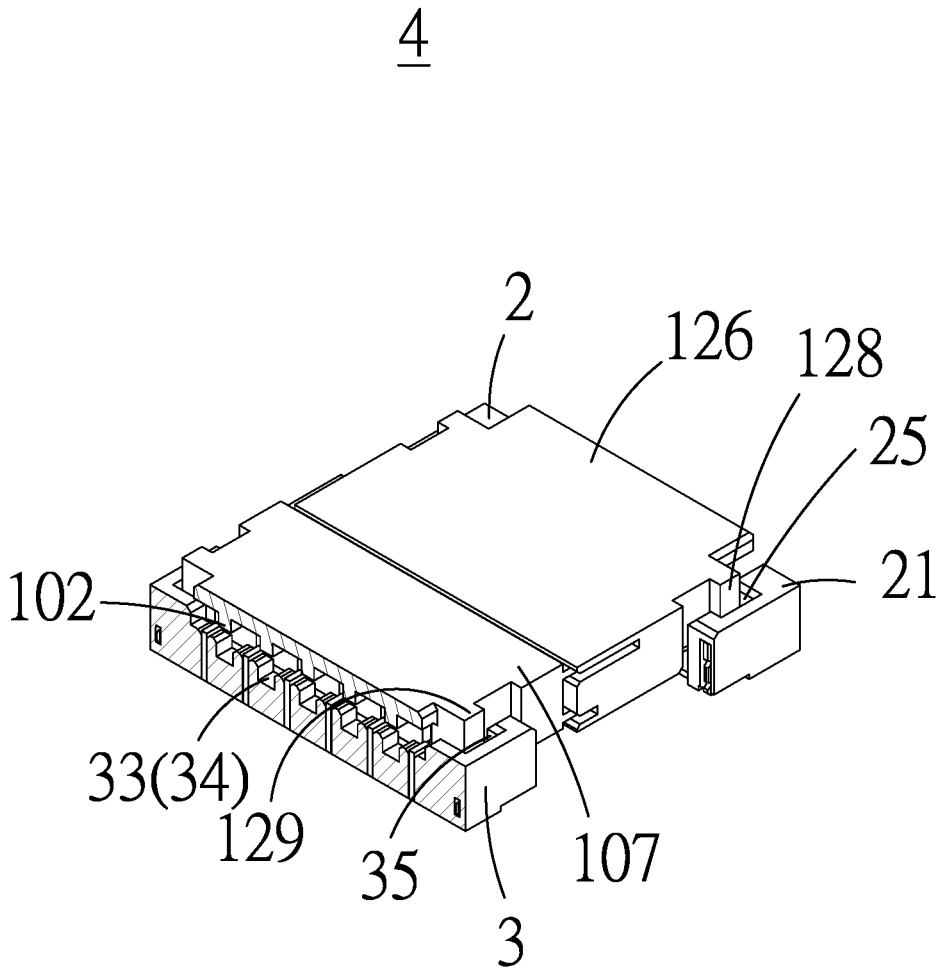
FIG. 9 is a schematic diagram of the connector assembly shown in FIG. 7 cut along line BB.

As shown in FIGS. 1 and 7, for easy installation, the first jumper connector body case 101 can be formed with a first force applying plate 126 extended above the first board edge connector body case 21, for allowing the first jumper connector body case 101 to move by applying force to the first force applying plate 126. The second jumper connector body case 107 can be formed with a second force applying plate 127 extended above the second board edge connector body case 31, for allowing the second jumper connector body case 107 to move by applying force to the second force applying plate 127. Moreover, the first guiding structure 102 of the first jumper connector body case 101 is provided on a side of the first force applying plate 126 facing the first board edge connector body case 21, to allow the first guiding structure 102 to smoothly approach the third guiding structure 23 for easy installation. And, the second guiding structure 108 of the second jumper connector body case 107 is provided on a side of the second force applying plate 127 facing the second board edge connector body case 31, to allow the second guiding structure 108 to smoothly approach the fourth guiding structure 33 for easy installation.

Therefore, in the connector assembly and the jumper connector thereof according to the present invention, there are provided a plurality of jumper connector body cases that can move relative to each other in an X direction to form misalignment in a way of allowing attaching portions of conductive terminals in the jumper connector body cases to turn correspondingly to be aligned with blade conductors of board edge connectors on circuit boards. Further in the present invention, the attaching portions of the conductive terminals in the jumper connector body cases can also move in Z and Y directions in order to have alignment with the blade conductors of the board edge connectors on the circuit boards. By such structural design, even if the circuit boards incur problems like poor processing quality or position offset, the jumper connector according to the present invention can still effectively bridge and join the board edge connectors on the circuit boards, thereby desirably accomplishing electrical connection between multiple circuit boards on electronic equipment.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. A jumper connector having two sides respectively coupled to a first board edge connector and a second board edge connector, the first board edge connector including a first board edge connector body case and first board edge connector blade conductors, the second board edge connector including a second board edge connector body case and second board edge connector blade conductors, wherein the first board edge connector body case has a third guiding structure, the first board edge connector blade conductors are embedded in the first board edge connector body case, the second board edge connector body case has a fourth guiding structure, and the second board edge connector blade conductors are embedded in the second board edge connector body case, the jumper connector including:

a first jumper connector body case for being coupled to the first board edge connector body case, the first jumper connector body case including a first guiding structure, a first internal space, a first engaging structure, a first inserting structure and a first exposing structure;

a second jumper connector body case for being coupled to the second board edge connector body case, the second jumper connector body case including a second guiding structure, a second internal space, a second engaging structure, a second inserting structure and a second exposing structure; and conductive terminals, each of which has two ends bent in U-shape to form a first attaching portion and a second attaching portion respectively; wherein, the first and second engaging structures are capable of being engaged with each other to join the first and second jumper connector body cases together so as to integrate the first and second internal spaces to form an integral receiving space;

the conductive terminals are capable of being accommodated in the integral receiving space, with the first and second attaching portions being exposed by the first and second exposing structures respectively;

the first and third guiding structures are capable of providing mutual guidance to allow the first attaching portions to move relative to the first board edge connector in a first Z direction to be attached to the first board edge connector blade conductors, and further allow the first attaching portions to move relative to the first board edge connector in a first Y direction to adjust relative positions of the first attaching portions and the first board edge connector;

the second and fourth guiding structures are capable of providing mutual guidance to allow the second attaching portions to move relative to the second board edge connector in a second Z direction to be attached to the second board edge connector blade conductors, and further allow the second attaching portions to move relative to the second board edge connector in a second Y direction to adjust relative positions of the second attaching portions and the second board edge connector; and the first and second inserting structures are capable of being inserted to each other to allow relative movement of the first and second jumper connector body cases in an X direction, so as to align the first and second attaching portions with the first and second board edge connector blade conductors respectively.

2. The jumper connector according to claim 1, wherein the first attaching portions have first gripping parts for gripping the first board edge connector blade conductors to keep the first attaching portions attached to the first board edge connector blade conductors, and the second attaching portions have second gripping parts for gripping the second board edge connector blade conductors to keep the second attaching portions attached to the second board edge connector blade conductors.

3. The jumper connector according to claim 1, wherein the first attaching portions have first abutting parts for abutting the first jumper connector body case, to allow the first attaching portions to turn using the first jumper connector body case as a pivot to be aligned with the first board edge connector blade conductors, and the second attaching portions have second abutting parts for abutting the second jumper connector body case, to allow the second attaching portions to turn using the second jumper connector body case as a pivot to be aligned with the second board edge connector blade conductors.

4. The jumper connector according to claim 1, wherein under the first attaching portions there are formed first inserting openings for allowing the first board edge connector blade conductors to be inserted upwards into the first attaching portions so as to couple the first attaching portions to the first board edge connector blade conductors, and under the second attaching portions there are formed second inserting openings for allowing the second board edge connector blade conductors to be inserted upwards into the second attaching portions so as to couple the second attaching portions to the second board edge connector blade conductors.

5. The jumper connector according to claim 1, wherein the first jumper connector body case further includes a first blocking structure capable of being in contact with the second inserting structure to block relative movement of the first and second jumper connector body cases in a third Y direction or a third Z direction, and the second jumper connector body case further includes a second blocking structure capable of being in contact with the first inserting structure to block relative movement of the first and second jumper connector body cases in a fourth Y direction or a fourth Z direction.

6. The jumper connector according to claim 1, wherein the first jumper connector body case further includes a first spacing structure for providing room for the second engaging structure to allow relative movement of the first and second jumper connector body cases in the X direction, and the second jumper connector body case further includes a second spacing structure for providing room for the first engaging structure to allow relative movement of the first and second jumper connector body cases in the X direction.

7. The jumper connector according to claim 1, wherein the first jumper connector body case further includes a first force applying plate extended above the first board edge connector body case, for allowing the first jumper connector body case to move by a force applied to the first force applying plate, and the second jumper connector body case further includes a second force applying plate extended above the second board edge connector body case, for allowing the second jumper connector body case to move by a force applied to the second force applying plate, wherein the first guiding structure is formed on a side of the first force applying plate facing the first board edge connector body case, and the second guiding structure is formed on a side of the second force applying plate facing the second board edge connector body case.

8. A connector assembly, including:

a first board edge connector including a first board edge connector body case and first board edge connector blade conductors, wherein the first board edge connector body case has a third guiding structure, and the first board edge connector blade conductors are embedded in the first board edge connector body case;

a second board edge connector including a second board edge connector body case and second board edge connector blade conductors, wherein the second board edge connector body case has a fourth guiding structure, and the second board edge connector blade conductors are embedded in the second board edge connector body case; and a jumper connector having two sides respectively coupled to the first board edge connector and the second board edge connector, the jumper connector including:

a first jumper connector body case for being coupled to the first board edge connector body case, the first jumper connector body case including a first guiding structure, a first internal space, a first engaging structure, a first inserting structure and a first exposing structure;

a second jumper connector body case for being coupled to the second board edge connector body case, the second jumper connector body case including a second guiding structure, a second internal space, a second engaging structure, a second inserting structure and a second exposing structure; and conductive terminals, each of which has two ends bent in U-shape to form an elastic first attaching portion and an elastic second attaching portion respectively; wherein, the first and second engaging structures are capable of being engaged with each other to join the first and second jumper connector body cases together so as to integrate the first and second internal spaces to form an integral receiving space;

the conductive terminals are capable of being accommodated in the integral receiving space, with the first and second attaching portions being exposed by the first and second exposing structures respectively;

the first and third guiding structures are capable of providing mutual guidance to allow the first attaching portions to move relative to the first board edge connector in a first Z direction to be attached to the first board edge connector blade conductors, and further allow the first attaching portions to move relative to the first board edge connector in a first Y direction to adjust relative positions of the first attaching portions and the first board edge connector;

the second and fourth guiding structures are capable of providing mutual guidance to allow the second attaching portions to move relative to the second board edge connector in a second Z direction to be attached to the second board edge connector blade conductors, and further allow the second attaching portions to move relative to the second board edge connector in a second Y direction to adjust relative positions of the second attaching portions and the second board edge connector; and the first and second inserting structures are capable of being inserted to each other to allow relative movement of the first and second jumper connector body cases in an X direction, so as to align the first and second attaching portions with the first and second board edge connector blade conductors respectively.

9. The connector assembly according to claim 8, wherein the first and third guiding structures are respectively composed of structurally matching convex portions and concave portions, wherein above the third guiding structure there is formed a first entry for allowing the first guiding structure to downwards enter the third guiding structure so as to achieve mutual guidance between the first and third guiding structures, and the second and fourth guiding structures are respectively composed of structurally matching convex portions and concave portions, wherein above the fourth guiding structure there is formed a second entry for allowing the second guiding structure to downwards enter the fourth guiding structure so as to achieve mutual guidance between the second and fourth guiding structures.

10. The connector assembly according to claim 9, wherein the first board edge connector body case further includes a third side assembling structure, the second board edge connector body case further includes a fourth side assembling structure, the first jumper connector body case further includes a first side assembling structure, and the second jumper connector body case further includes a second side assembling structure, wherein, the first and third side assembling structures are capable of being assembled together to guide the first jumper connector body case to enter the first board edge connector body case until the first guiding structure touches the third guiding structure, and the second and fourth side assembling structures are capable of being assembled together to guide the second jumper connector body case to enter the second board edge connector body case until the second guiding structure touches the fourth guiding structure.

11. The connector assembly according to claim 10, wherein the first and third side assembling structures are respectively composed of structurally matching convex portions and concave portions, wherein above the third side assembling structure there is formed a first opening for allowing the first side assembling structure to downwards enter the third side assembling structure so as to assemble the first and third side assembling structures, and the second and fourth side assembling structures are respectively composed of structurally matching convex portions and concave portions, wherein above the fourth side assembling structure there is formed a second opening for allowing the second side assembling structure to downwards enter the fourth side assembling structure so as to assemble the second and fourth side assembling structures, wherein the first opening is taller than the first entry, and the second opening is taller than the second entry.

* * * * *